United States Patent [19]

Tanaka et al.

[11] 4,217,406

[45] Aug. 12, 1980

[54] CROSS-LINKING REACTION DURING MELT KNEADING PRODUCES RESINOUS ELECTROPHOTOGRAPHIC TONER

[75] Inventors: Koichi Tanaka; Kenji Kobayashi; Shigeo Aonuma, all of Minami-ashigara, Japan

[73] Assignee: Fuji Xerox Co. Ltd., Tokyo, Japan

[21] Appl. No.: 929,594

[22] Filed: Jul. 31, 1978

[30] Foreign Application Priority Data

Jul. 29, 1977 [JP] Japan ..... 52/90410

[51] Int. Cl.[2] ..... G03G 9/14

[52] U.S. Cl. ..... 430/137; 430/109; 528/503; 428/402; 260/42; 260/42.29

[58] Field of Search ..... 252/62.1 R, 62.1 P; 528/503; 96/15 D; 428/402; 260/42, 42.29

[56] References Cited

U.S. PATENT DOCUMENTS

| | | | |
|---|---|---|---|
| 2,418,688 | 4/1947 | Atwood | 528/603 |
| 3,740,334 | 6/1973 | Jacknow et al. | 252/62.1 |
| 3,775,326 | 11/1973 | Westdale | 252/62.1 |

*Primary Examiner*—John D. Welsh

*Attorney, Agent, or Firm*—Sughrue, Rothwell, Mion, Zinn and Macpeak

[57] ABSTRACT

A process for producing an electrophotographic toner composition comprising melt-kneading (a) a cross-linkable functional group-containing resin and (b) a colorant, with (c) a polyfunctional resin capable of reacting with the cross-linkable functional group-containing resin (a) or a low molecular weight cross-linking agent capable of cross-linking the cross-linkable functional group-containing resin (a), the amount of the polyfunctional resin or the low molecular weight cross-linking agent (c) being such that the amount of the functional groups present in the polyfunctional resin or the low molecular weight cross-linking agent (c) being equivalent to or less than equivalent to the amount of the functional group present in the cross-linkable functional group-containing resin (a); cross-linking by heating and generating a shearing force during melt-kneading to produce a slightly cross-linked colored resin such that the adhesion properties and the grindability of the slightly cross-linked colored resin are not deteriorated, and pulverizing the slightly cross-linked colored resin to produce the electrophotographic toner composition.

19 Claims, No Drawings

CROSS-LINKING REACTION DURING MELT KNEADING PRODUCES RESINOUS ELECTROPHOTOGRAPHIC TONER

BACKGROUND OF THE INVENTION

1. Field of the Invention

The present invention relates to electrophotographic toner compositions. More particularly, the present invention is concerned with processes for producing improved electrophotographic toner compositions.

2. Description of the Prior Art

In general, those developers used in electrophotography are subjected to vigorous mechanical friction during the course of development. Therefore, usual developer compositions contain those resins having high mechanical strength, for example, tough, high molecular weight resins.

These resins, however, have the disadvantage that, since a large quantity of heat is required in fixing them on a support, such as paper, when the intention is to increase the rate of development of an electrophotographic duplicator equipped with a heat roll-type fixing unit, a large scaled apparatus for generating a large quantity of heat or for removing the heat generated is needed.

In order to eliminate the above defects, those developers containing low molecular weight resins have been proposed. While these developers eliminate the above defects, they inevitably have the disadvantages that when a heated roll-type fixing unit is employed, a decomposition of the low molecular weight resins takes place at the time of fusing, they adhere not only to a support, such as paper, but also adhere to heated rolls, thereby forming a film on the heated rolls, and the phenomenon called "off-set" occurs when they are used.

Thus, to remove the above-described defects, electrophotographic toner compositions containing cross-linked resins have been developed. These compositions have many advantages. For example, they have high mechanical strength and good grindability, they can be fixed at relatively low temperatures and off-set scarcely occurs when they are used.

These electrophotographic toner compositions containing cross-linked resins are usually produced by a method comprising the following steps:

(1) a polymerization step in which the monomers are polymerized;

(2) a cross-linking step in which a cross-linked resin is obtained by cross-linking;

(3) a melt-kneading step in which the cross-linked resin, a colorant and the like are kneaded; and (4) a pulverizing step in which those particles having the desired size are obtained.

SUMMARY OF THE INVENTION

Since heat is always applied in the melt-kneading step (3), investigations were made to reduce the steps needed for producing electrophotographic toner compositions containing cross-linked resins by utilizing the heat applied in the melt-kneading step (3). As a result, it has now been found that the cross-linking step (2) can be essentially omitted by causing cross-linking to occur in the melt-kneading step (3) and that electrophotographic toner compositions can be obtained without affecting the above-described advantages of the cross-linked resins.

Accordingly, an object of the present invention is to provide a process for producing an electrophotographic toner composition in which cross-linking at the time of melt-kneading can be achieved and where a separate cross-linking step can be essentially eliminated.

Another object of the present invention is to provide a process for producing an electrophotographic toner composition which eliminates the above-described defects of conventional toner compositions.

This invention attains the above-described objects and provides a process for producing an electrophotographic toner composition which comprises melt-kneading (a) a cross-linkable functional group-containing resin and (b) a colorant with (c) a polyfunctional resin capable of reacting the cross-linkable functional group-containing resin or a low molecular weight cross-linking agent, such that the amount of the functional groups present in the polyfunctional resin or low molecular weight cross-linking agent (c) is equivalent to or less than equivalent to the amount of the functional groups present in the cross-linkable functional group-containing resin (a), preferably an equivalency ratio of 0.5:1 to 0.1:1;

cross-linking by heating and generating a shearing force during melt-kneading to produce a slightly cross-linked colored resin such that the adhesion properties and grind-ability of the colored resin are not deteriorated; and pulverizing the slightly cross-linked colored resin to produce an electrophotographic toner composition.

DETAILED DESCRIPTION OF THE INVENTION

When the amount of the functional groups present in the material used as component (c) is more than an equivalent amount, the cross-linking of the resin proceeds to an excessive degree. As a result, the colored resin obtained is insoluble, cannot be melted, and is difficult to pulverize.

Suitable examples of cross-linkable functional group-containing resins which can be used as component (c) in the present invention are thermosetting acrylic or polyester resins; that is, those acrylic copolymers and polyester resins produced by the procedures described below.

ACRYLIC COPOLYMERS

Suitable acrylic copolymers which can be used are produced by radical polymerizing (A) an acrylate or a methacrylate, (B) a vinyl monomer reactive on heating and (C) a modified vinyl monomer copolymerizable with the acrylate or methacrylate (A) and the vinyl monomer (B) in a suitable solvent.

(A) Acrylates and Methacrylates: methyl acrylate, ethyl acrylate, butyl acrylate, 2-ethylhexyl acrylate, methyl methacrylate, ethyl methacrylate, butyl methacrylate, cyclohexyl methacrylate, stearyl methacrylate, etc.

(B) Heat-Reactive Vinyl Monomers: acrylic acid, methacrylic acid, maleic acid, hydroxyethyl methacrylate, hydroxypropyl acrylate, glycidyl acrylate, alkoxymethylol acrylamide, etc.

(C) Modified Vinyl Monomers: styrene, vinyl toluene, methylstyrene, acrylonitrile, methacrylonitrile, etc.

POLYESTER RESINS

Suitable polyester resins which can be used are produced by polymerizing (D) a divalent alcohol, (E) a dicarboxylic acid and (F) a polyhydric alcohol having 3 or more hydroxy groups or a polycarboxylic acid having 3 or more carboxy groups.

(D) Divalent Alcohols: ethylene glycol, triethylene glycol, 1,2-propylene glycol, 1,3-propylene glycol, 1,4-butanediol, neopentyl glycol, 1,4-butenediol, 1,4-bis(hydroxymethyl)cyclohexane, bisphenol A, hydrogenated bisphenol A, poly(ethylene oxy) bisphenol A, etc.

(E) Dicarboxylic Acids: maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, the anhydrides thereof, the esters thereof with lower alcohols.

(F)-1 Polyhydric Alcohols Having Three or More Hydroxy Groups: glycerin, trimethylolpropane, pentaerythritol, etc.

(F)-2 Polycarboxylic Acids Having Three or More Carboxy Groups: trimellitic acid, pyromellitic acid, etc.

While the proportion of functional groups present in these resins for component (a) can range from about 5 to about 50 mol%, it is preferred for the proportion of the functional groups to range from 15 to 30 mol%.

Those acrylic or polyester resins having a functional group proportion below about 5 mol% do not act as cross-linking agents. On the other hand, when those resins having a functional group proportion of above about 50 mol% are employed, cross-linking proceeds to an excessive extent, and, as a result, the composition obtained becomes insoluble, is not meltable and is difficult to pulverize.

Although polymers suitable for use in toners, in general, can have a number average molecular weight of about 1,500–50,000, the number average molecular weight of the polymers used in the present invention is preferably from about 1,500 to about 5,000.

The glass transition temperature of the polymers used in the present invention is preferably as low as possible, otherwise agglomeration will occur at room temperature (about 20°–30° C.). In more detail, a preferred glass transition temperature is between 40° C. and 60° C.

Suitable examples of materials which can be employed as component (c) and mixed with the resins described above for component (a) and colorants as component (b) for cross-linking include polyfunctional group-containing resins containing two or more functional groups capable of reacting with the functional groups of the cross-linkable resins as component (a) or low molecular weight cross-linking agents capable of cross-linking the cross-linkable resins as component (a) can be used.

Suitable polyfunctional group-containing resins which can be used as component (c) in this invention are, for example, epoxy resins, polyamide resins, polysulfide resins, ureaformaldehyde resins, phenol based formaldehyde resins, melamine resins, aniline resins, toluenesulfonamide resins, isocyanate resins, alkyd resins, furfural resins, silicone resins and the like.

Suitable low molecular weight cross-linking agents which can be used as component (c) in this invention are, for example, ethylenediamine, diethylenediamine, triethylenetetramine, diethylaminopropylamine, m-phenylenediamine, naphthylenediamine, succinic acid, phthalic acid and the like.

In general, cross-linking increases the glass transition point of a resin. For example, in the case of an acrylic resin, when the degree of cross-linking increases by 1 mol%, the glass transition point increases by several degrees centigrade. Cross-linking also increases the toughness of a resin, which, however, adversely influences the grindability of the resin in production of the toner. Therefore, the cross-linking of the cross-linkable resin must be carried out to such an extent that the glass transition point of the resin is not markedly increased, and to such an extent that the grindability is not decreased. For these reasons, the material used as component (c) is employed such that the functional group amount be less than that equivalent on a molar basis, preferably from 0.5:1 to 0.1:1 on a molar basis, to the amount of the acrylic or polyester resin used as component (a).

Any suitable pigments or dyes which can be used as colorants for toner powders in general can be employed as the colorant, component (b), in this invention. Toner colorants are well known and, for example, carbon black, Nigrosine, Aniline Blue, Arco Oil Blue, Chrome Yellow, Ultramarine Blue, Monoline Yellow, Methylene Blue Chloride, Phthalocine Blue, Malachite Green Oxalate, lamp black, Rose Bengale and mixtures thereof can be used. The pigment or dye as a colorant is employed in the toner in an amount sufficient to strongly color the toner so that a sharp image be formed on paper.

Thus, where conventional xerographic duplication of a printed document is desired, the toner comprises a black pigment such as carbon black or a black dye such as amaplast black dye. The amount of the pigment added is preferably about 3 to 20% by weight based on the total weight of the colored toner. When the colorant for the toner is a dye, a corresponding small amount of the colorant is used.

Although the composition of the present invention may be prepared using any known toner mixing and pulverizing methods, what is required is a heating to at least about 50° C. during melt-kneading to cause cross-linking. The resulting mixture of the cross-linkable resin, the colorant and the material used as component (c) is then crushed and pulverized using any known method.

Where the toner composition of the present invention is employed in the cascade developing process, the magnetic brush developing process, the C-cell developing process, etc., the toner composition must have an average particle size, expressed in weight percent, of not more than about 30 microns. The best results are obtained when the particle size ranges from about 4 to 20 microns. When the toner composition is used in the powder cloud developing process, the toner composition preferably is a powder having a particle diameter of slightly less than 1 micron.

Coated or uncoated carriers used in the cascade developing process, magnetic brush developing process, C-cell developing process, etc., as described above are well known. In the present invention, those carrier particles made of any suitable material can be employed provided that the toner powder gains an electric charge of the opposite polarity to that of the carrier particles when brought in intimate contact with the carrier particles so that the powder attaches to and covers the carrier particles.

The toner composition of the present invention is used in development of an electrostatic latent image formed on the surface of any known photoconductive layer.

The following examples and comparative examples are given by way of illustration to specifically illustrate in greater detail methods of producing the toner composition of the present invention and a development method using the toner composition. Unless otherwise indicated, all parts are by weight.

COMPARATIVE EXAMPLE 1

A mixture of 90 parts of an acrylic resin containing glycidyl groups as functional groups and 10 parts of carbon black (Black Pearls L) was introduced into an intensive mixer at an oil pressure of 7 kg/cm$^2$ and a compressor pressure of 5.0 kg/cm$^2$ and kneaded therein at 80° C. for 5 minutes. The molten resin mixture withdrawn from the mixer after kneading was sufficiently fluid to an extent that it hanged down by gravity. When cooled, the resin mixture was quite brittle and could be easily crushed by a light impact. The resin mixture was crushed to a particle size of several hundred microns in a free mill and then finely pulverized by Jet-mizer (produced by Nippon Neumatic Ind. Co., Ltd.) under the conditions of an air pressure of 4 kg/cm$^2$ and a feed rate of 8 kg/hr. A fine powder having an average particle size of 12$\mu$ was thus obtained, which was used as a toner.

The thus-obtained toner was used in combination with iron powder carriers on 720 Xerox Duplicator, and the fixing point (temperature at which the toner was completely fixed) and the off-set point (temperature at which off-set occurred) were measured. The fixing point was 125° C.; the toner was fixed at a quite low temperature. However, off-set was observed at 170° C.

EXAMPLE 1

A mixture of 81 parts of an acrylic resin containing glycidyl groups as functional groups, 9 parts of an alkylphenol modified xylene resin and 10 parts of carbon black (Black Pearls L) was introduced into an intensive mixer at an oil pressure of 7 kg/cm$^2$ and a compressor pressure of 5.0 kg/cm$^2$ and kneaded at 80° C. for 5 minutes. The molten resin mixture withdrawn from the intensive mixer after kneading hardly hanged down by gravity. When compared with Comparative Example 1, where no alkylphenol modified xylene resin was employed, it can be seen that a cross-linking effect was obtained.

The thus-obtained resin, when cooled, could be easily crushed by a light impact as in Comparative Example 1. The resin was crushed to a particle size of several hundred microns with a free mill and then finely pulverized with a Jet-mizer. To obtain a toner powder having an average particle size of 12$\mu$, an air pressure of 6.3 kg/cm$^2$ and a feed rate of 4 kg/hr were used. It can be seen that the grindability of the toner composition of this invention decreased in comparison with the grindability of the toner composition of Comparative Example 1 where no alkylphenol modified xylene resin was employed. However, the grindability of the toner composition of this invention is still good when it is taken into account that conventional toners are usually produced under pulverization conditions of an air pressure of 6.3 kg/cm$^2$ and a feed rate of 1.2 to 2.0 kg/hr.

The thus-obtained toner was used in combination with iron powder carriers on a 720 Xerox Duplicator, and the fixing point and the off-set point were measured. The fixing point was 125° C.; the toner was fixed at a low temperature as in the case where no alkylphenol modified xylene resin was used. However, off-set was not observed even at 230° C.

EXAMPLE 2

A mixture of 85 parts of an acrylic resin containing glycidyl groups as functional groups, 5 parts of phthalic acid and 10 parts of carbon black (Black Pearls L) was fed to an intensive mixer at an oil pressure of 7 kg/cm$^2$ and a compressor pressure of 5.0 kg/cm$^2$ and kneaded therein at 80° C. for 5 minutes. The molten resin mixture withdrawn from the mixer after kneading did not hang down by gravity, and a cross-linking effect was thus obtained. When cooled, the resin mixture could be easily pulverized by a light impact. The resin was roughly crushed to several hundred microns with a free mill and then finely pulverized with a Jet-mizer. Under the conditions of an air pressure of 6.3 kg/cm$^2$ and a feed rate of 4 kg/hr, a fine toner powder having an average particle size of 12$\mu$ was obtained.

The thus-obtained toner was used in admixture with iron powder carriers on a 720 Xerox Duplicator, and the fixing point and the off-set point were measured. The fixing point was 125° C. and off-set was not observed even at 230° C.

COMPARATIVE EXAMPLE 2

A mixture of 90 parts of a polyester resin containing carboxyl groups as functional groups and 10 parts of carbon black (Black Pearls L) was introduced into an intensive mixer at an oil pressure of 7 kg/cm$^2$ and a compressor pressure of 5.0 kg/cm$^2$ and kneaded at 80° C. for 5 minutes. The molten resin mixture withdrawn from the mixer after kneading was quite viscous and had great fluidity, and thus it hanged down by gravity. When cooled, the resin mixture could be easily crushed by a light impact. The resin mixture was crushed to several hundred microns and then finely pulverized with a Jet-mizer. Under the conditions of an air pressure of 4 kg/cm$^2$ and 8 kg/hr, a fine toner powder having an average particle size of 12$\mu$ was obtained.

The thus-obtained toner was used in combination with iron powder carriers on a 720 Xerox Duplicator, and the fixing point and the off-set point were measured. The fixing point was 130° C. which was a low temperature. However, off-set was observed at 170° C.

EXAMPLE 3

A mixture of 81 parts of a polyester resin containing carboxyl groups as functional groups, 9 parts of an epoxy resin and 10 parts of carbon black (Black Pearls L) was introduced into an intensive mixer at an air pressure of 7 kg/cm$^2$ and a compressor pressure of 5.0 kg/cm$^2$ and kneaded therein at 80° C. for 5 minutes. The molten resin mixture withdrawn from the mixer after kneading did not have the fluidity as in Comparative Example 2 and did not hang down by gravity. It can thus be seen that a cross-linking effect was obtained. When cooled, the resin mixture could be easily crushed by a light impact. The resin mixture was crushed to several hundred microns in a free mill and then pulverized with a Jet-mizer. In this case, the pulverization conditions of an air pressure of 6.3 kg/cm$^2$ and a feed rate of 3 kg/hr were needed, and it can thus be seen that the grindability decreased in comparison with the resin mixture where no epoxy resin was added. However, the resin mixture had good grindability as compared with conventional toner materials.

The toner obtained above was used in admixture with iron powder carriers on a 720 Xerox Duplicator, and the fixing point and the off-set point were measured. The fixing point was 130° C. and off-set was not observed even at 230° C.

From the experimental data obtained above, it can be seen that a toner obtained according to the method of the present invention was cross-linked to such an extent that the fixing properties and the grindability at the time of kneading were not degraded, and it markedly improved the fading latitude.

While the invention has been described in detail and with reference to specific embodiments thereof, it will be apparent to one skilled in the art that various changes and modifications can be made therein without departing from the spirit and scope thereof.

What is claimed is:

1. A process for producing an electrophotographic toner composition comprising melt-kneading (a) a cross-linkable functional group-containing resin containing functional groups in a proportion of about 5 to about 50 mol% and (b) a colorant, with (c) a polyfunctional resin capable of reacting with the cross-linkable functional group-containing resin (a) or a low molecular weight cross-linking agent capable of cross-linking the cross-linkable functional group-containing resin (a), the amount of the polyfunctional resin or the low molecular weight cross-linking agent (c) being such that the amount of the functional groups present in the polyfunctional resin or the low molecular weight cross-linking agent (c) being equivalent to or less than equivalent to the amount of the functional groups present in the cross-linkable functional group-containing resin (a); cross-linking by heating and generating a shearing force during melt-kneading to produce a slightly cross-linked colored resin such that the adhesion properties and the grind-ability of the slightly cross-linked colored resin are not deteriorated, and pulverizing the slightly cross-linked colored resin to produce the electrophotographic toner composition.

2. The process of claim 1, wherein said cross-linkable functional group-containing resin (a) is an acrylic resin or a polyester resin.

3. The process of claim 2, wherein said acrylic resin is an acrylic copolymer comprising the radical polymerization product of (A) an acrylate or a methacrylate, (B) a vinyl monomer reactive on heating and (C) a modified vinyl monomer copolymerizable with said acrylate or methacrylate (A) and said vinyl monomer (B).

4. The process of claim 2, wherein said polyester resin is the condensation polymerization product of (D) a divalent alcohol, (E) a dicarboxylic acid and (F) a polyhydric alcohol having 3 or more hydroxy groups or a polycarboxylic acid having 3 or more carboxyl groups.

5. The process of claim 1, wherein said cross-linkable functional group-containing resin (a) has a molecular weight ranging from about 1,500 to about 5,000.

6. The process of claim 1, wherein said cross-linkable functional group-containing resin (a) has a glass transition temperature of between 40° C. and 60° C.

7. The process of claim 1, wherein said polyfunctional resin (c) capable of reacting with said cross-linkable functional group-containing resin (a) is an epoxy resin, a polyamide resin, a polysulfide resin, a urea-formaldehyde resin, a phenol-formaldehyde resin, a melamine resin, an aniline resin, a toluenesulfonamide resin, an isocyanate resin, an alkyd resin, a furfural resin or a silicone resin.

8. The process of claim 1, wherein said low molecular weight cross-linking agent (c) is ethylenediamine, diethylenediamine, triethylenetetramine, diethylaminopropylamine, m-phenylenediamine, naphthylenediamine, succinic acid or phthalic acid.

9. The process of claim 1, wherein the amount of the functional groups present in said cross-linkable functional group-containing resin (a) to the functional groups present in said polyfunctional resin or said low molecular weight cross-linking agent (c) ranges from 0.5:1 to 0.1:1 on molar basis.

10. The process of claim 1, wherein said colorant is a pigment or a dye.

11. The process of claim 1, wherein said melt-kneading is at a temperature of at least about 50° C.

12. The process of claim 1, wherein said pulverizing is to a particle size of about 30 microns or less.

13. The process of claim 1 wherein the only cross-linking step to produce said toner composition is during said melt-kneading.

14. The process of claim 1 wherein said cross-linkable functional-group containing resin contains functional groups in a proportion of 15 to 30 mol%.

15. The process of claim 1 wherein said cross-linking is carried out to such an extent that the glass transition point of the resin is not substantially increased.

16. The process of claim 1 wherein said cross-linkable functional-group containing resin (a) is an acrylic resin or a polyester resin having a molecular weight ranging from about 1500 to 5000, wherein said polyfunctional resin (c) is an epoxy resin, a polyamide resin, a polysulfide resin, a urea-formaldehyde resin, a phenol-formaldehyde resin, a melamine resin, an aniline resin, a toluenesulfonamide resin, an isocyanate resin, an alkyd resin, a furfural resin or a silicone resin, said low molecular weight cross-linking agent (c) is ethylenediamine, diethylenediamine, triethylenetetramine, diethylaminopropylamine, m-phenylenediamine, naphthylenediamine, succinic acid or phthalic acid, and wherein the amount of the functional groups present in said cross-linkable functional group-containing resin (a) to the functional groups present in said polyfunctional resin or said low molecular cross-linking agent (c) ranges from 0.5:1 to 1.0:1 on a molar basis, wherein said colorant is a pigment or a dye, wherein said melt-kneading is at a temperature of at least about 50° C. and wherein said pulverizing is to a particle size of about 30 microns or less.

17. The process of claim 16 wherein said colorant is carbon black.

18. The process of claim 1 wherein said toner composition consists essentially of the reaction products to components (a), (c) and said colorant.

19. The process of claim 16 wherein component (a) is an acrylic resin and component (c) is an alkyl phenol modified xylene resin and said colorant is carbon black.

* * * * *